US011083285B2

(12) United States Patent
Koehn et al.

(10) Patent No.: US 11,083,285 B2
(45) **Date of Patent: *Aug. 10, 2021**

(54) ELECTRIC TABLE STAND FOR SIMPLE ASSEMBLY AND ADJUSTMENT

(71) Applicants: TIMOTION TECHNOLOGY CO., LTD., New Taipei (TW); ADJUSTME sourcing ApS, Copenhagen (DK)

(72) Inventors: John Aage Koehn, Copenhagen (DK); Yu-Chang Lin, New Taipei (TW)

(73) Assignees: TIMOTION TECHNOLOGY CO., LTD., New Taipei (TW); ADJUSTME SOURCING APS, Copenhagen (DK)

( * ) Notice: Subject to any disclaimer, the term of this patent is extended or adjusted under 35 U.S.C. 154(b) by 0 days.

This patent is subject to a terminal disclaimer.

(21) Appl. No.: 15/931,472

(22) Filed: May 13, 2020

(65) Prior Publication Data

US 2020/0359784 A1 Nov. 19, 2020

Related U.S. Application Data

(60) Provisional application No. 62/848,565, filed on May 15, 2019.

(51) Int. Cl.

| | |
|---|---|
| ***A47B 21/02*** | (2006.01) |
| ***A47B 9/20*** | (2006.01) |
| ***A47B 21/03*** | (2006.01) |

(52) U.S. Cl.

CPC ..... *A47B 21/02* (2013.01); *A47B 9/20* (2013.01); *A47B 21/03* (2013.01); *A47B 2200/0051* (2013.01); *A47B 2200/0059* (2013.01)

(58) Field of Classification Search

USPC ..... 108/144.11, 147, 157.1, 157.17; 248/188.5

See application file for complete search history.

(56) References Cited

U.S. PATENT DOCUMENTS 4,966,341 A 10/1990 Borsani
7,111,564 B2 * 9/2006 Chang ..... A47B 13/06 108/155

(Continued)

FOREIGN PATENT DOCUMENTS

CN 109527802 A 3/2019
DE 4021248 A1 * 1/1992 ..... A47B 21/03

(Continued)

OTHER PUBLICATIONS

Technical Examination Report dated Feb. 25, 2021 of the corresponding Denmark patent application No. PA202070314.

*Primary Examiner* — Jose V Chen

(74) *Attorney, Agent, or Firm* — Chun-Ming Shih; HDLS IPR Services

(57) ABSTRACT

An electric table stand for simple assembly and adjustment includes a beam structure (10), support bars (20), and upright structures (30). Each of the support bars (20) includes a base (21) and a plurality of arms (211, 212, 213) extended from the base (21), wherein an accommodating space (A) is defined by the base (21) and the arms (211, 212, 213). One arm (213) of each of the support bars (20) supports one end of the beam structure (10), and the beam structure (10) is operatively moved in or out of the accommodating space (A). The upright structures (30) are connected to the support bars (20). Accordingly, it is easy to adjust and position each support bar (20) and each upright structure (30) on the beam structure (10).

14 Claims, 12 Drawing Sheets

(56) References Cited

U.S. PATENT DOCUMENTS

| | | | | |
|---|---|---|---|---|
| 7,703,398 | B2 * | 4/2010 | Brauning | A47B 1/08 108/50.02 |
| 9,038,549 | B1 * | 5/2015 | Zebarjad | A47B 9/02 108/147 |
| 10,555,602 | B1 * | 2/2020 | Lu | A47B 9/04 |
| 2005/0263042 | A1 | 12/2005 | Martin et al. | |
| 2009/0078171 | A1 * | 3/2009 | Frost | A47B 13/00 108/50.02 |
| 2011/0215207 | A1 * | 9/2011 | Koder | H02K 11/35 248/157 |
| 2016/0113391 | A1 * | 4/2016 | Wang | A47B 9/20 248/605 |
| 2017/0224101 | A1 * | 8/2017 | Bruder | A47B 13/06 |
| 2017/0251802 | A1 * | 9/2017 | Lu | A47B 3/06 |
| 2018/0064241 | A1 * | 3/2018 | Tseng | F15B 15/1409 |
| 2018/0110324 | A1 | 4/2018 | Keller et al. | |
| 2019/0069669 | A1 * | 3/2019 | Hall | A47B 21/06 |
| 2020/0154876 | A1 * | 5/2020 | Liu | A47B 1/08 |
| 2020/0154881 | A1 * | 5/2020 | Applegate | A47B 9/20 |
| 2020/0214439 | A1 * | 7/2020 | Bennett | A47B 9/20 |
| 2020/0359783 | A1 * | 11/2020 | Koehn | H02K 5/225 |

FOREIGN PATENT DOCUMENTS

| | | | | | |
|---|---|---|---|---|---|
| DE | 102015105827 | A1 * | 10/2016 | | A47B 13/003 |
| DE | 102017125390 | A1 * | 5/2019 | | A47B 9/04 |
| JP | 3222124 | U * | 7/2019 | | A47B 9/04 |
| WO | WO-2015180723 | A1 * | 12/2015 | | A47B 9/20 |
| WO | WO-2016121732 | A1 * | 8/2016 | | A47B 21/02 |
| WO | WO-2019149296 | A1 * | 8/2019 | | A47B 9/00 |

* cited by examiner

ELECTRIC TABLE STAND FOR SIMPLE ASSEMBLY AND ADJUSTMENT

BACKGROUND

Technical Field

The present invention relates to a field of an electric table stand and in particular, to an electric table stand for simple assembly and adjustment.

Related Arts

As users have different body shapes, heights, and user habits, commonly used fixed tables have been gradually replaced. As a result, there has been a trend and a mainstream for developing electric height adjustable tables. After height adjustment, the electric height adjustable table can accommodate users of different heights and body shapes to improve their comfort.

Conventional electric height adjustable tables mainly include a beam structure and a pair of upright structures, and each upright structure is screw-fixed to one end of the beam structure. Most adjustments are done by removing the screws, then moving each upright structure to a desired position, and after that, using hand tools to fasten the screws one by one. Such an adjustment method is quite cumbersome and inconvenient. In addition, unskilled users often have assembly errors such as mis-installation or misalignment (deviations).

In addition, during the assembly process, a lot of screws are used for locking and assembling, which is not only complicated to assemble but also requires a lot of labor and time. In addition, in order to provide support forces with stability, most of these electric height adjustable tables use a large number of metal parts, which makes the whole table bulky and heavy, so transportation of the table is quite inconvenient, and the transportation fees are also costly.

In view of the above, in order to improve and solve the above-mentioned shortcomings, the inventor made a lot of research with scientific principles, and finally came up with the present invention with a reasonable design to effectively improve the above-mentioned shortcomings.

SUMMARY

It is an objective of the present invention to provide an electric table stand for simple assembly and adjustment, so that each support bar and each upright structure on a beam structure can be adjusted and positioned with ease.

Accordingly, the present invention provides an electric table stand for simple assembly and adjustment, including a beam structure, support bars, and upright structures. Each of the support bars includes a base and a plurality of arms extended from the base, wherein an accommodating space is defined by the base and the arms. One arm of each of the support bars supports one end of the beam structure, and the beam structure is operatively moved in or out of the accommodating space. The upright structures are connected to the support bars respectively.

The present invention further has the following functions. Each end of the beam structure can be slidably connected to each arm. In a process of adjusting and moving each upright structure, there is no need to use any hand tools or unfasten screws. Thus, the ease and convenience of adjustment are greatly improved. In addition, an assembly process can be simplified and labor costs can be saved, and assembly errors such as mis-installation or mis-alignment (deviations) can be avoided. A casing pipe is used to enclose side section beams to prevent electrical components inside from being damaged by moisture. Upper covers and lower covers of a middle section beam and each side section beam are made of plastic insulating materials, so the electric table stand has reduced weight and also provides good insulation.

BRIEF DESCRIPTION OF THE DRAWINGS

The disclosure will become more fully understood from the detailed description and the drawings given herein below for illustration only, and thus does not limit the disclosure, wherein.

DETAILED DESCRIPTION

The detailed description and technical content of the present invention are described below in combination with the drawings. However, the drawings are provided for reference and explanation only, and are not intended to limit the present invention.

Figure 1:
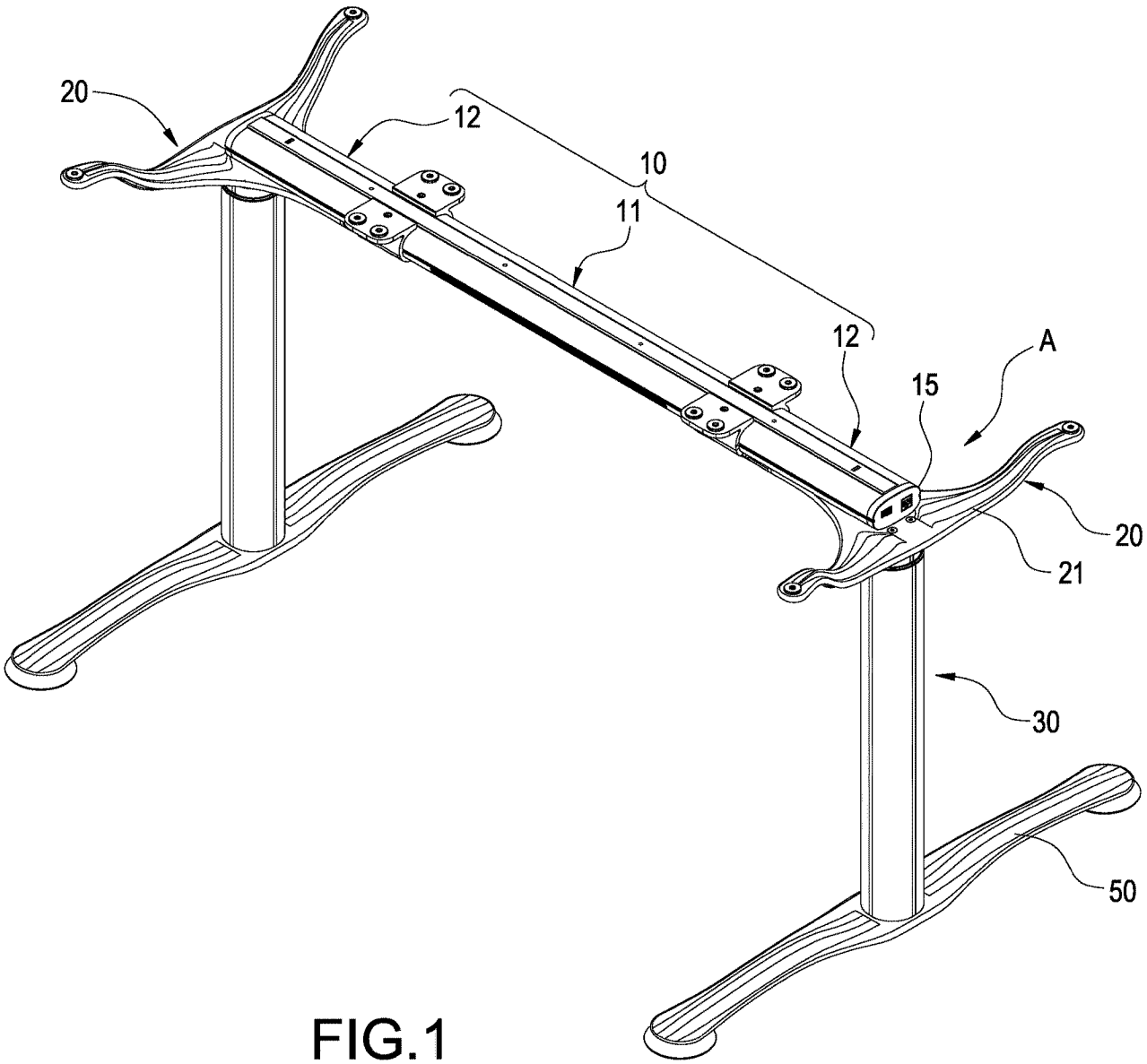
FIG. 1 is a schematic perspective view illustrating an electric table stand for simple assembly and adjustment of the present invention.
Figure 2:
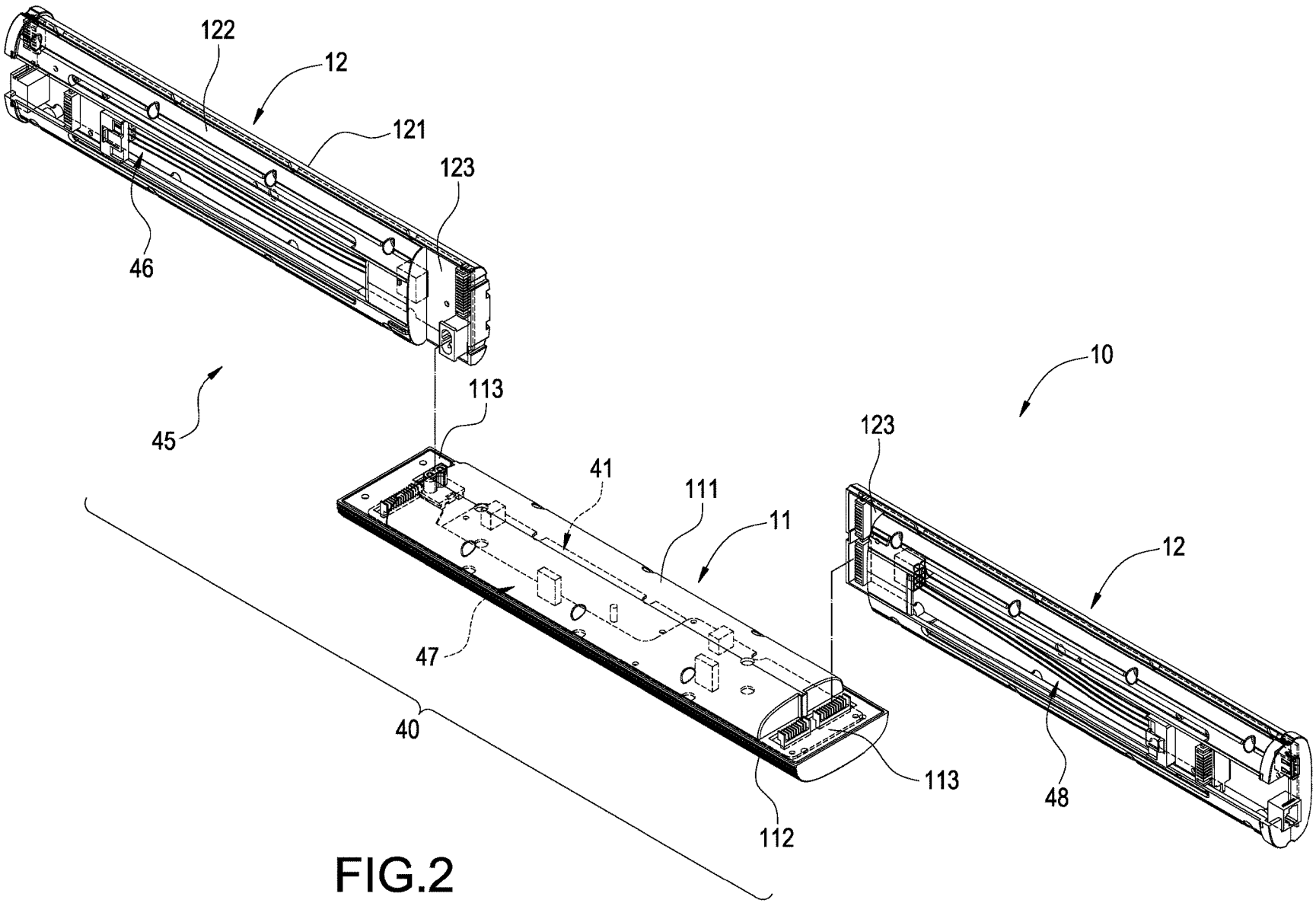
FIG. 2 is a perspective exploded view illustrating a beam structure and an electrical device of the present invention.
Figure 3:
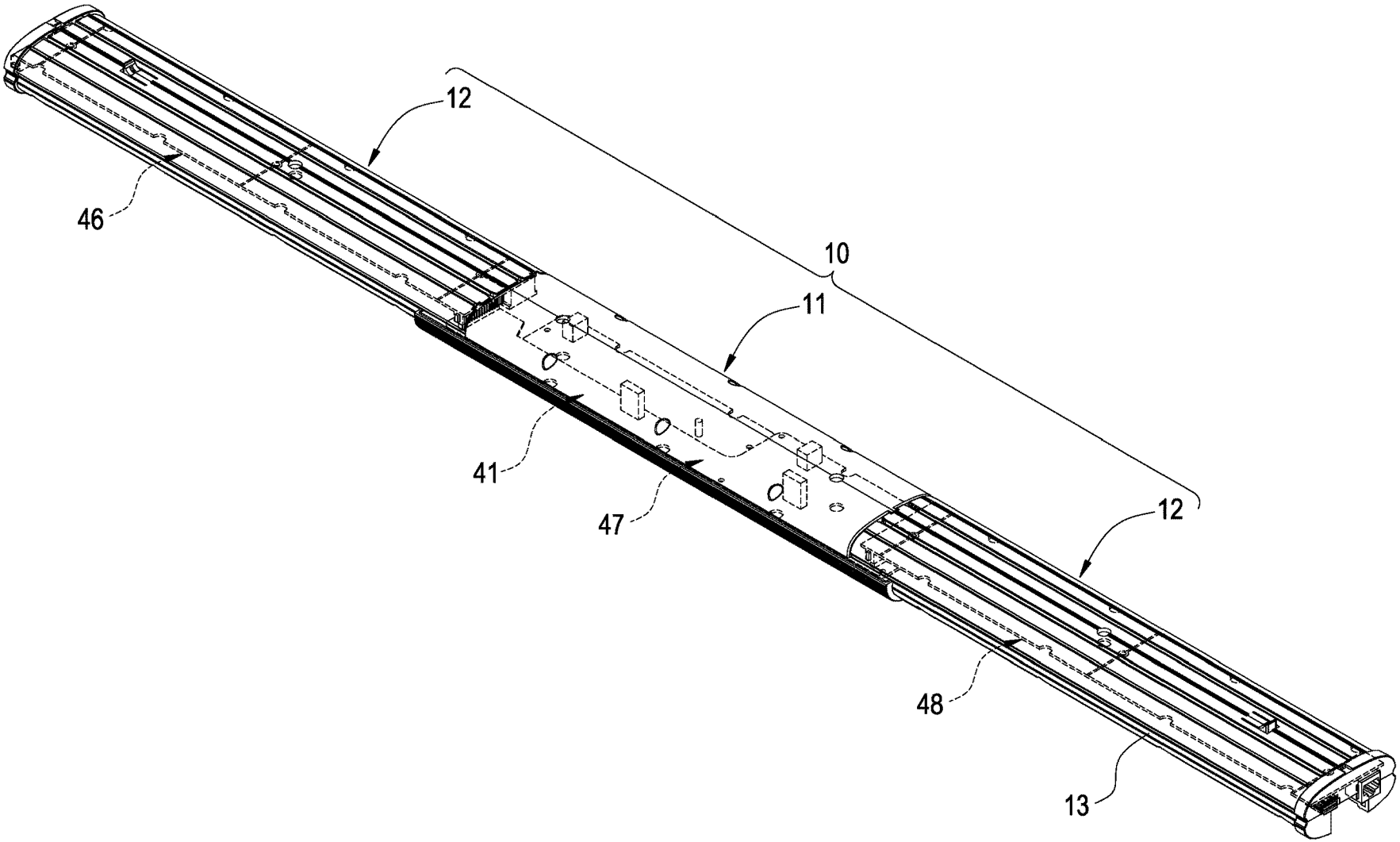
FIG. 3 is a schematic assembled view illustrating an assembled state after the beam structure and the electrical device are combined with the casing pipe according to the present invention.
Figure 4:
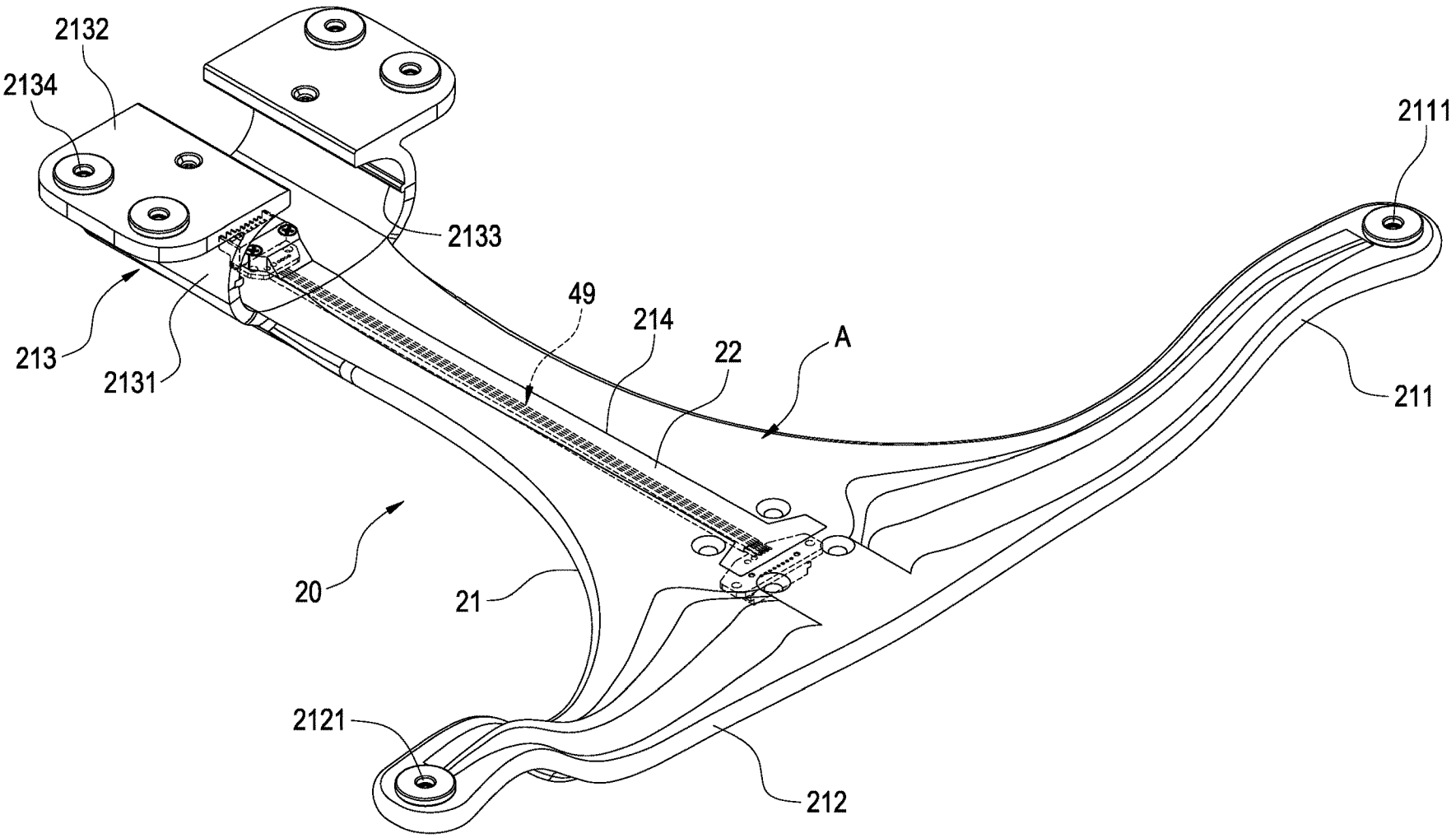
FIG. 4 is a schematic assembled view illustrating a support bar and a portion of a conductive circuit of the present invention.
Figure 5:
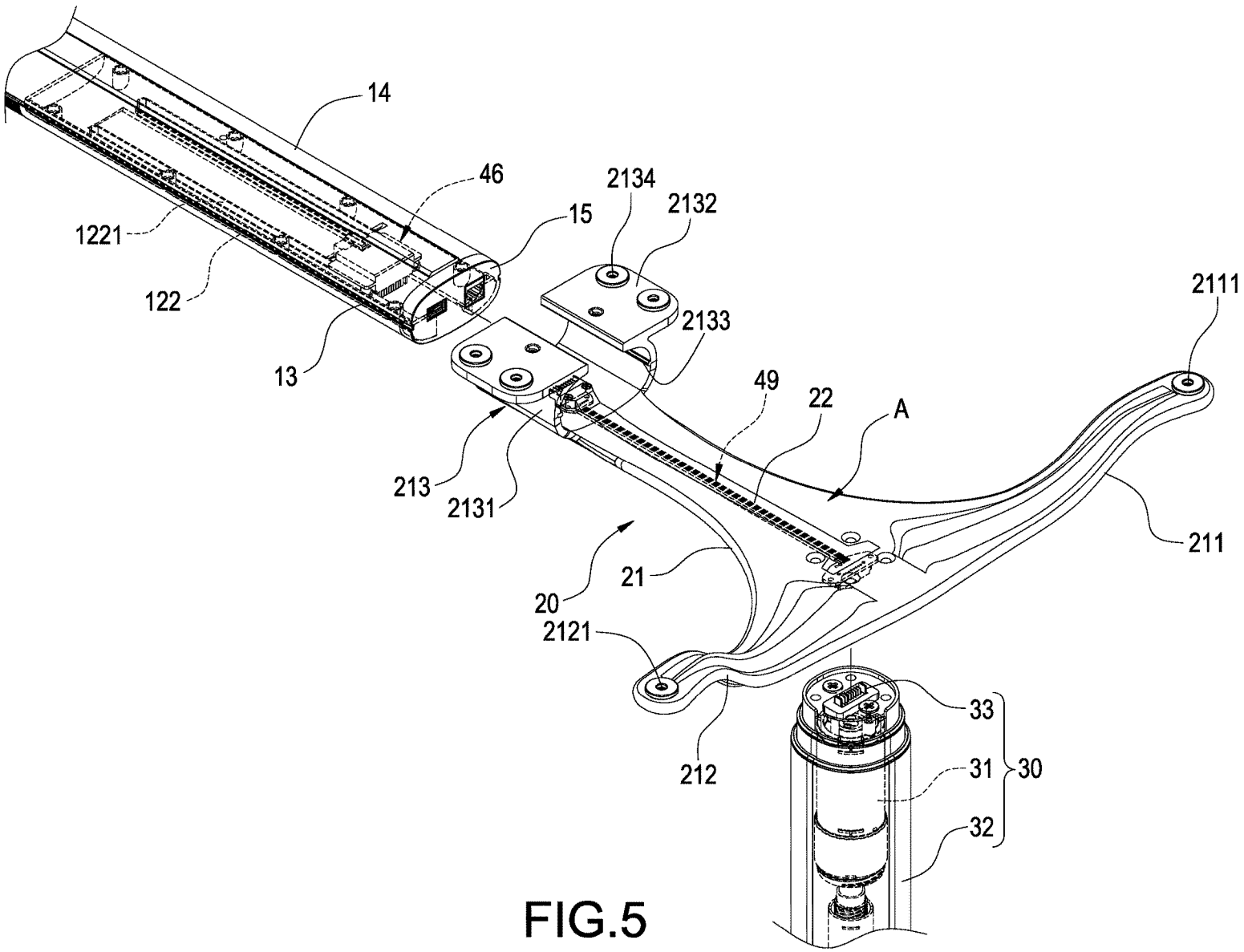
FIG. 5 is a perspective exploded view illustrating a portion of the beam structure, the support bar, and an upright structure according to the present invention.
Figure 6:
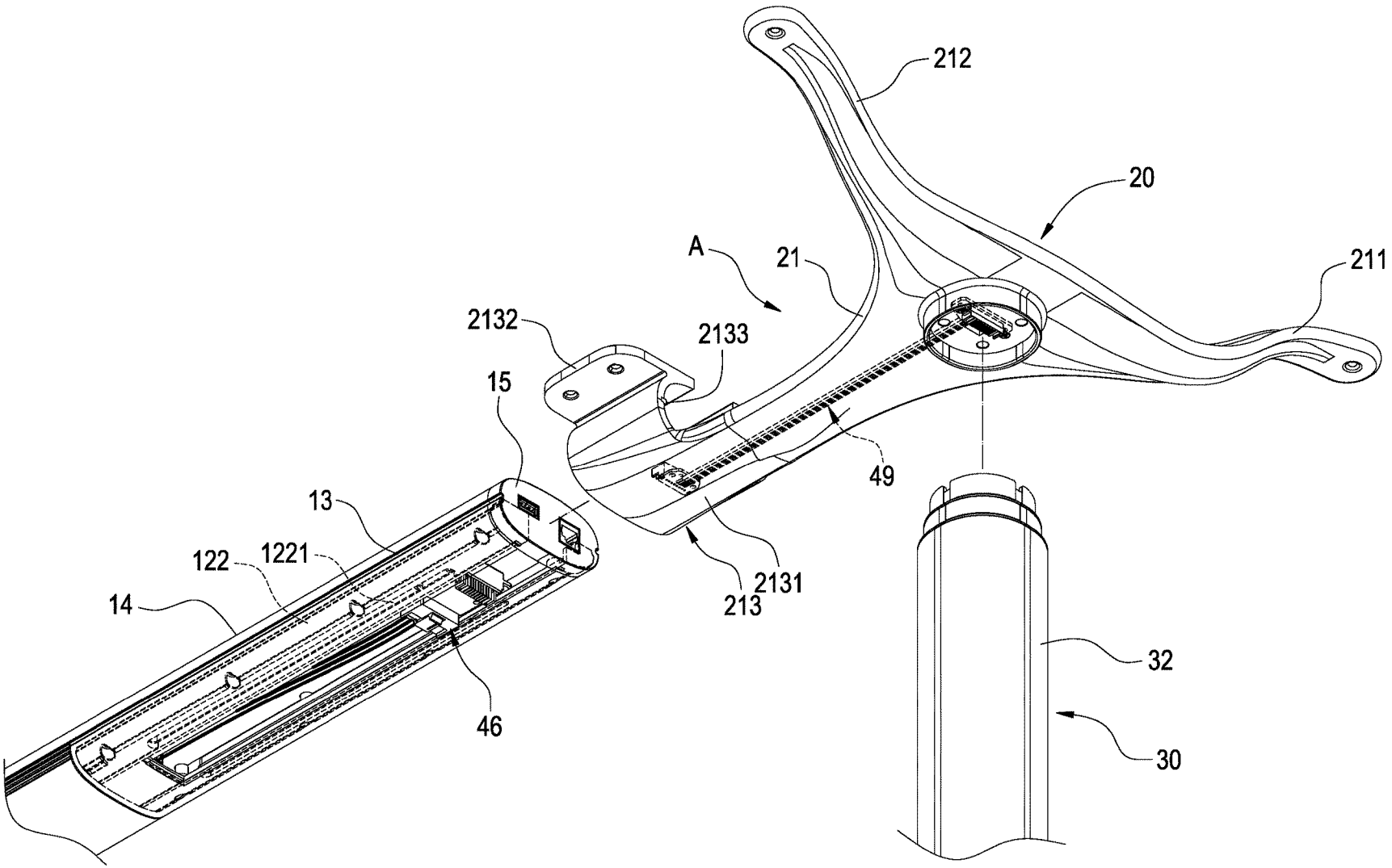
FIG. 6 is another perspective view of FIG. 5.
Figure 7:
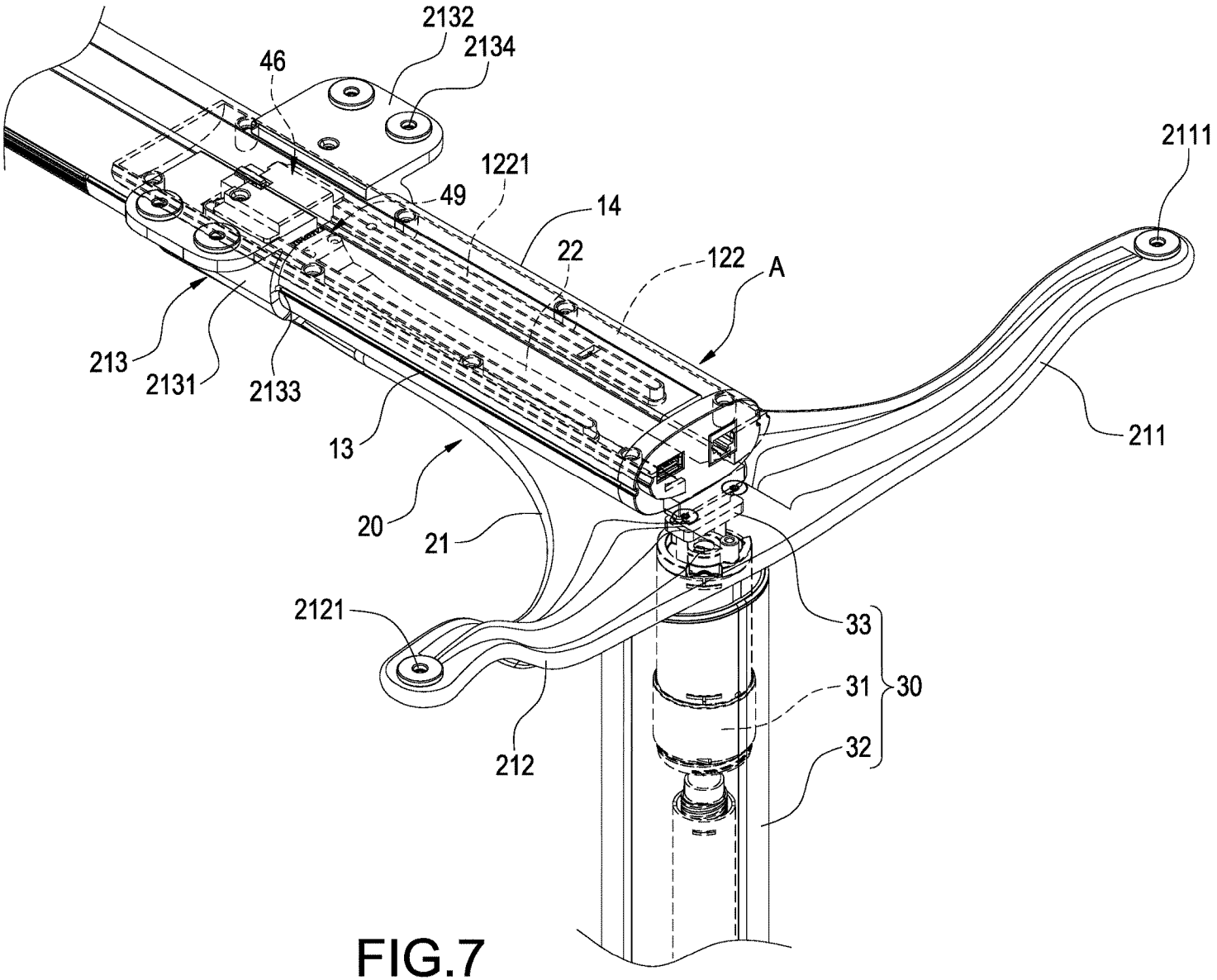
FIG. 7 is a perspective assembled view illustrating the beam structure, the support bar, and an upright structure of the present invention.

The present invention provides an electric table stand for simple assembly and adjustment. Referring to FIG. 1, the electric table stand mainly includes a beam structure 10, a pair of support bars 20, a pair of upright structures 30, an electrical device 40 (see FIG. 2) and a pair of bottom stands 50. Each of the bottom stands 50 is connected to one end of the upright structure 30 away from the support bar 20. Referring to FIGS. 2 and 3, the beam structure 10 mainly includes a middle section beam 11 and two side section beams 12. The middle section beam 11 can be made of plastic and other insulating material. The middle section beam 11 includes an upper cover 111 and a lower cover 112 assembled with the upper cover 111, and an assembled cross-section generally has an elliptical shape. Two joining portions 113 are provided at two ends of the middle section beam 11, respectively. Each of the side section beams 12 is also made of plastic or other insulating material and mainly includes an upper cover 121 and a lower cover 122 assembled with the upper cover 121, and an assembled cross-section of the upper cover 111 and the lower cover 122 also has an elliptical shape. One end of the side section beam 12 is provided with a linking portion 123, and each of the side section beams 12 is coupled to each of the joining portion 113 of the middle section beam 11 through the linking portion 123.

The beam structure 10 further includes a pair of guide grooves 13 which are defined in middle side edges of the middle section beam 11 and each side section beam 12 and are arranged corresponding to each other.

The beam structure 10 further includes a casing pipe 14. The casing pipe 14 encloses the middle section beam 11 and each of the side section beams 12.

The beam structure 10 further includes a pair of end covers 15. Each of the end covers 15 covers on one end of each side section beams 12 away from the middle section beam 11 and is connected to the casing pipe 14.

The electrical device 40 mainly includes a controller 41 and a conductive circuit 45. The controller 41 is installed inside the middle section beam 11 and is mainly used for rectification, filtering and voltage reduction, and other related work. The conductive circuit 45 mainly includes a first guide module 46, a second guide module 47, and a third guide module 48. The first guide module 46 is installed in the left one of the side section beams 12, the second guide module 47 is installed in the middle section beam 11, and the third guide module 48 is installed in the right one of the side section beam 12.

Referring to FIGS. 4 to 7, the support bars 20 mainly includes a base 21 made of aluminum alloy by die casting or the like, and generally has a T shape; however, the present application is not limited to this particular shape. The support bar 20 further includes a first arm 211 extended from one side of the base 21 and has a height difference with the base 21, a second arm 212 extended in an opposite direction to the first arm 11 and has a height difference with the base 21, and a third arm 213 extended away from a connection direction of the first arm 211 and the second arm 212 and has a height difference with the base 21. An accommodating space A is formed among the base 21, the first arm 211, the second arm 212, and the third arm 213. The beam structure 10 is operatively moved in or out of the accommodating space A. End portions of the first arm 211, the second arm 212, and third arm 213 away from the base 21 are on a same plane.

The conductive circuit 45 further includes a fourth guide module 49, and the fourth guide module 49 is installed in the base 21. The base 21 is provided with a wire-receiving groove 214, and the fourth guide module 49 is embedded in the wire-receiving groove 214 and fixed by a press plate 22. In addition, a through hole 2111 and a through hole 2121 are defined respectively in the end portion of the first arm 211 and the end portion of the second arm 212.

The third arm 213 includes a supporting element 2131 and a fixed plate 2132 extended horizontally from an end of the supporting element 2131. In the present embodiment, the supporting element 2131 has a C shape, but the present application is not limited to this particular shape. A pair of protruding strips 2133 protrude from an inner surface of the supporting element 2131, and each protruding strip 2133 is engaged with each guide groove 13 of the beam structure 10. A through hole 2134 is defined in each fixed plate 2132.

The upright structures 30 are connected to the support bars 20 respectively, and each upright structure 30 includes an electric motor 31 and a plurality of extendable tubes 32. The electric motor 31 is installed inside the extendable tubes 32 and is used to drive each extendable tube 32 to extend or retract. The electric motor 31 is electrically connected to the aforementioned fourth guide module 49 through an electrical contact 33, and the electrical contact 33 is fixed on an upper end surface of the extendable tube 32, thereby achieving electrical connection when the upright structure 30 and the support bar 20 are assembled.

Figure 8:
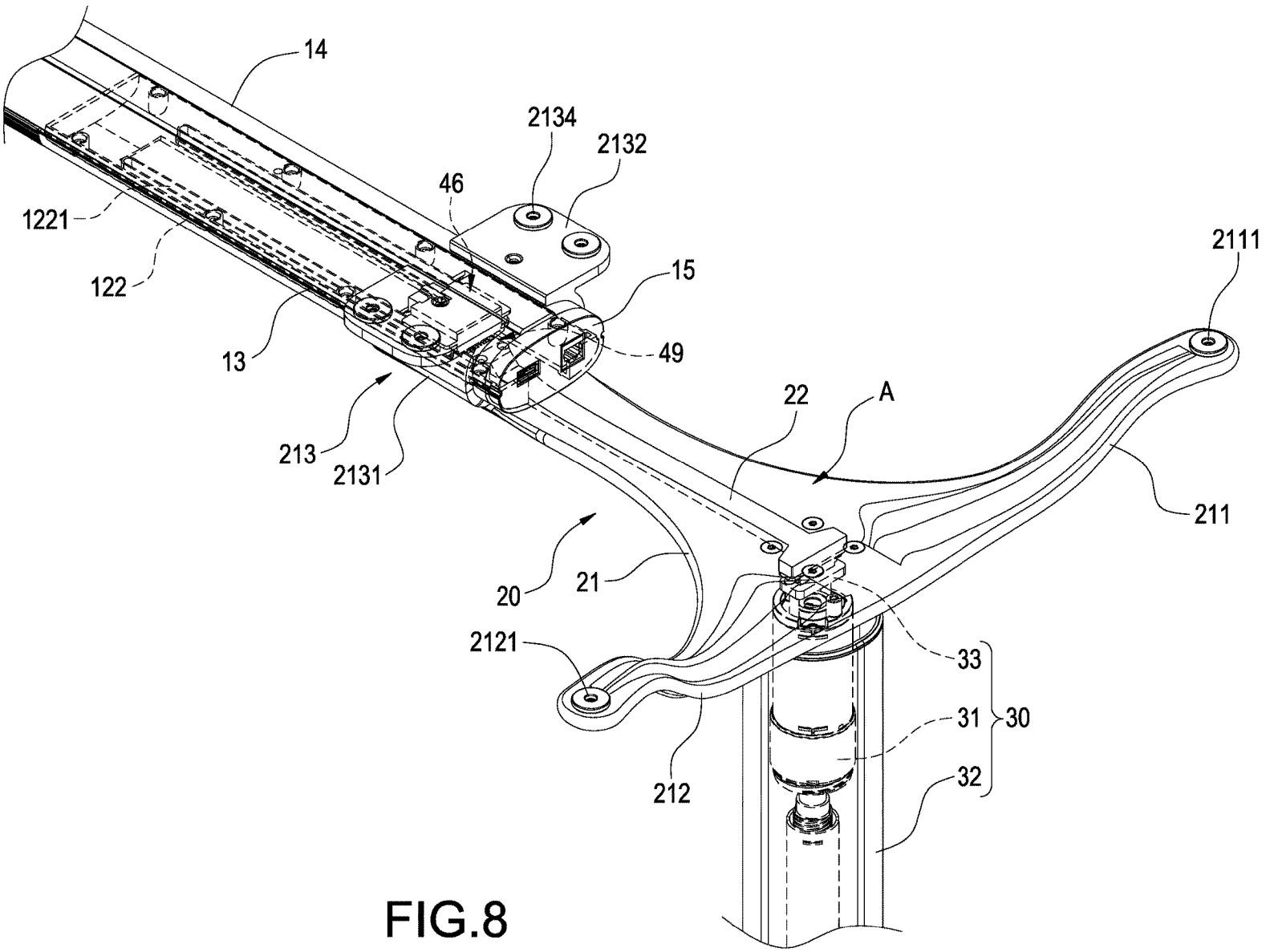
FIG. 8 is a use state view of the beam structure, the support bar, and the upright structure of the present invention.
Figure 9:
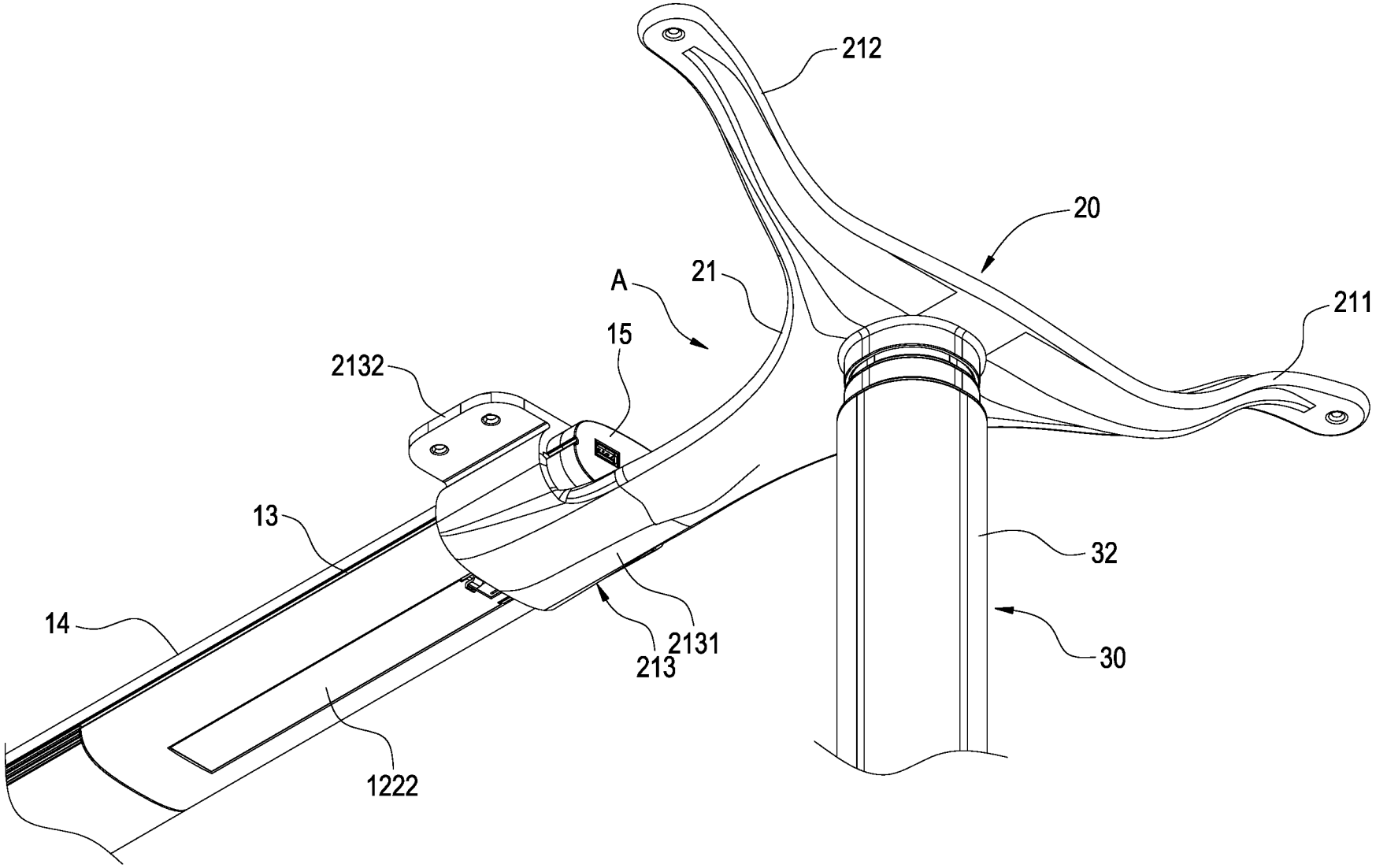
FIG. 9 is another perspective view of FIG. 8.

Referring to FIGS. 8 and 9, during use, the side section beams 12 are engaged with the respective corresponding protruding strips 2133 by using the guide grooves 13. Users can move the support bar 20 and the upright structure 30 together according to requirements, thereby adjusting relative positional relationship between the support bar 20, the upright structure 30, and the beam structure 10. In the foregoing process, a portion of the beam structure 10 that passes through the third arm 213 is operably moved in or out of the accommodating space A while the conductive circuit 45 is kept in an ON state.

Figure 10:
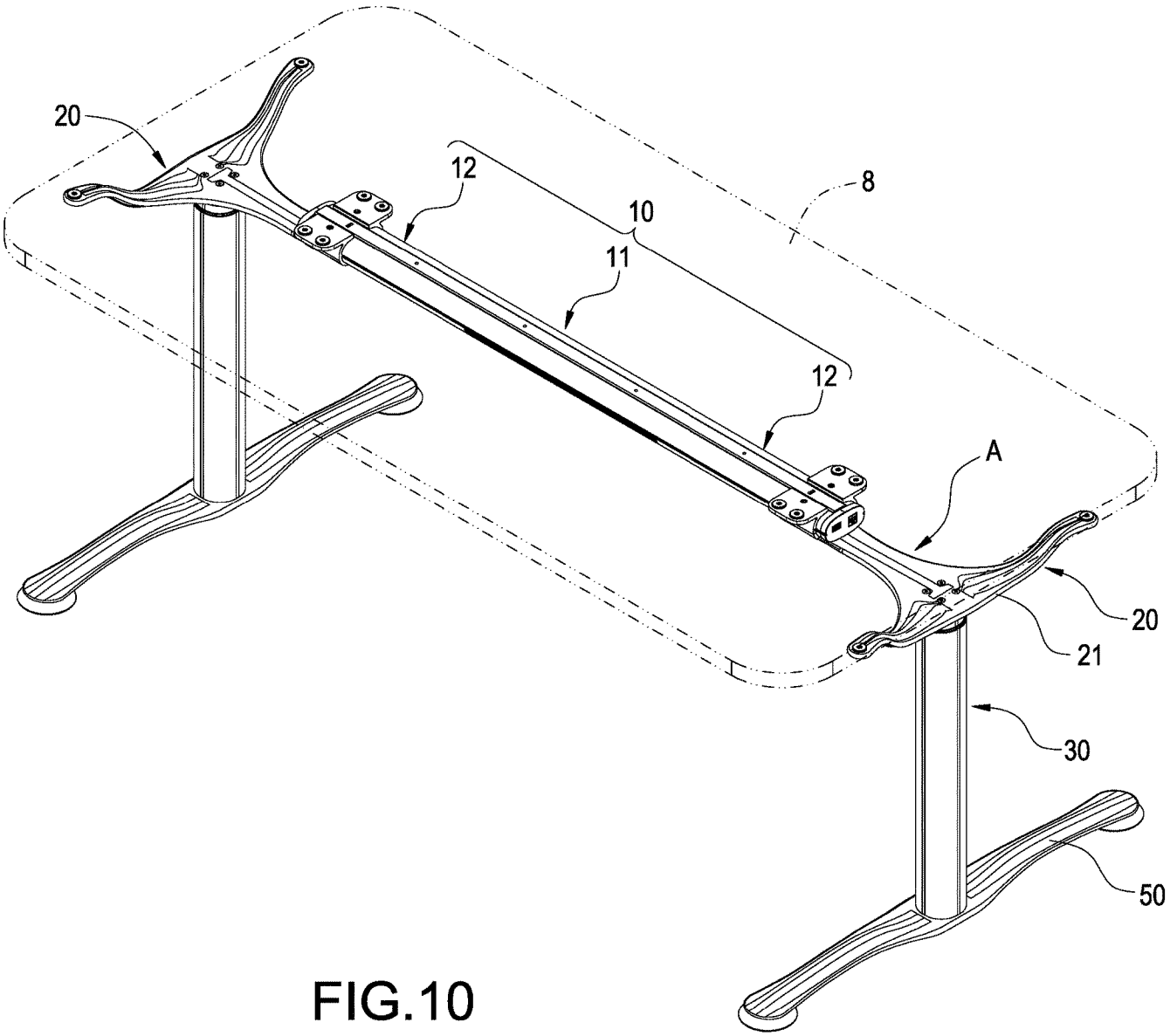
FIG. 10 is a schematic assembled view illustrating a table top board combined with an electric table stand for simple assembly and adjustment of the present invention.

Referring to FIG. 10, the electric table stand for simple assembly and adjustment according to the present invention can be combined with a table top board 8, and the table top board 8 is set on a support plane constructed by the first arm 211, the second arm 212, and the third arm 213 of each support bar 20. Moreover, the table top board 8 is fixed by fastening screws or other fastening elements in the through holes 2111, 2121, 2134.

Figure 11:
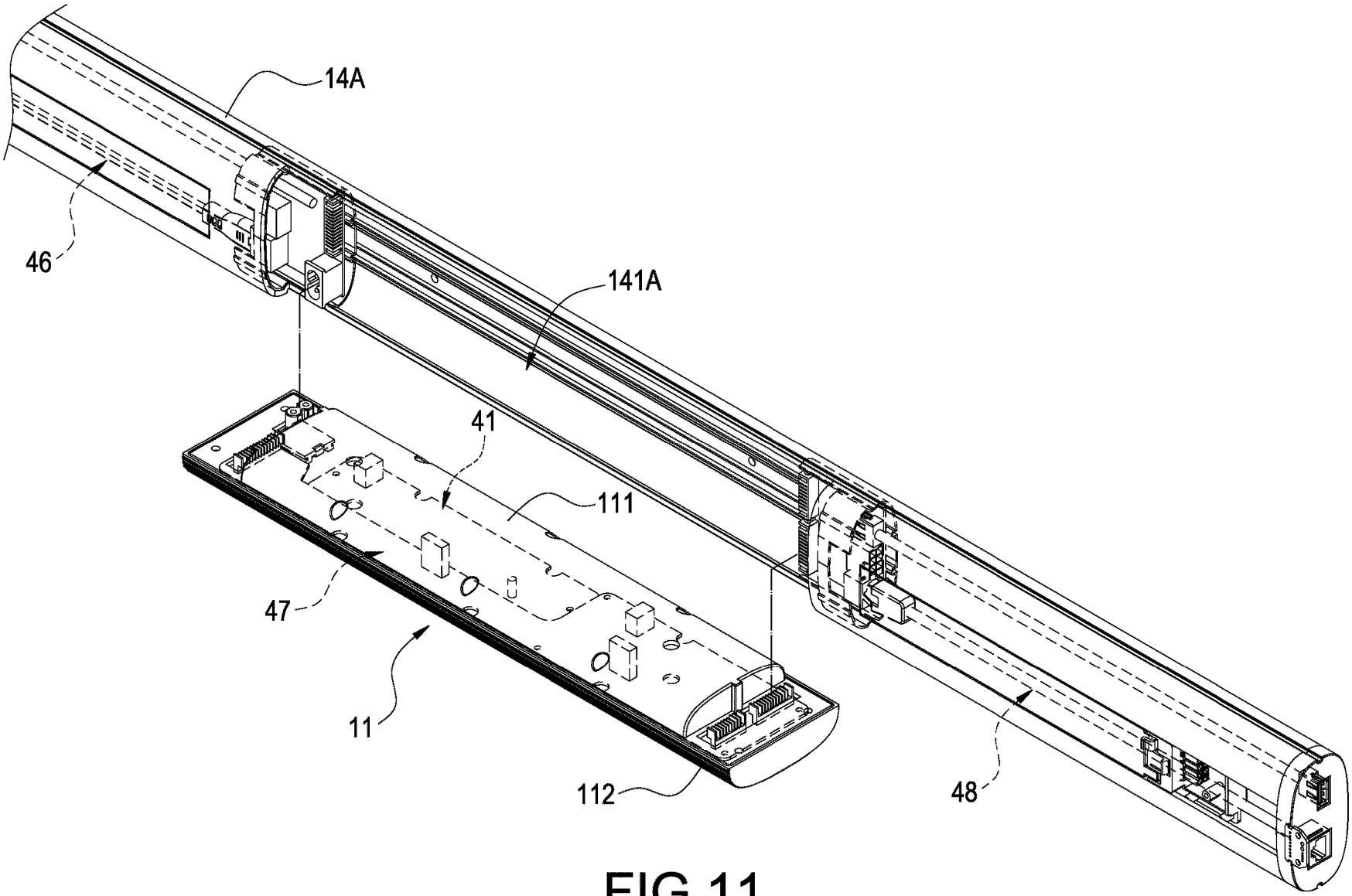
FIG. 11 is a perspective exploded view illustrating the beam structure according to another embodiment of the present invention.

As shown in FIG. 11, in addition to the above-mentioned embodiment, the beam structure 10 of the present invention can be provided with an opening 141A inside the casing pipe 14A. The first guide module 46 and the third guide module 48 are disposed on two sides of the casing pipe 14A. The controller 41 and the second guide module 47 are installed inside the middle section beam 11. The middle section beam 11 is coupled to the casing pipe 14A corresponding to the opening 141A. This way, the middle section beam 11 alone can be removed during maintenance, which facilitates the ease and convenience in assembly and maintenance.

Figure 12:
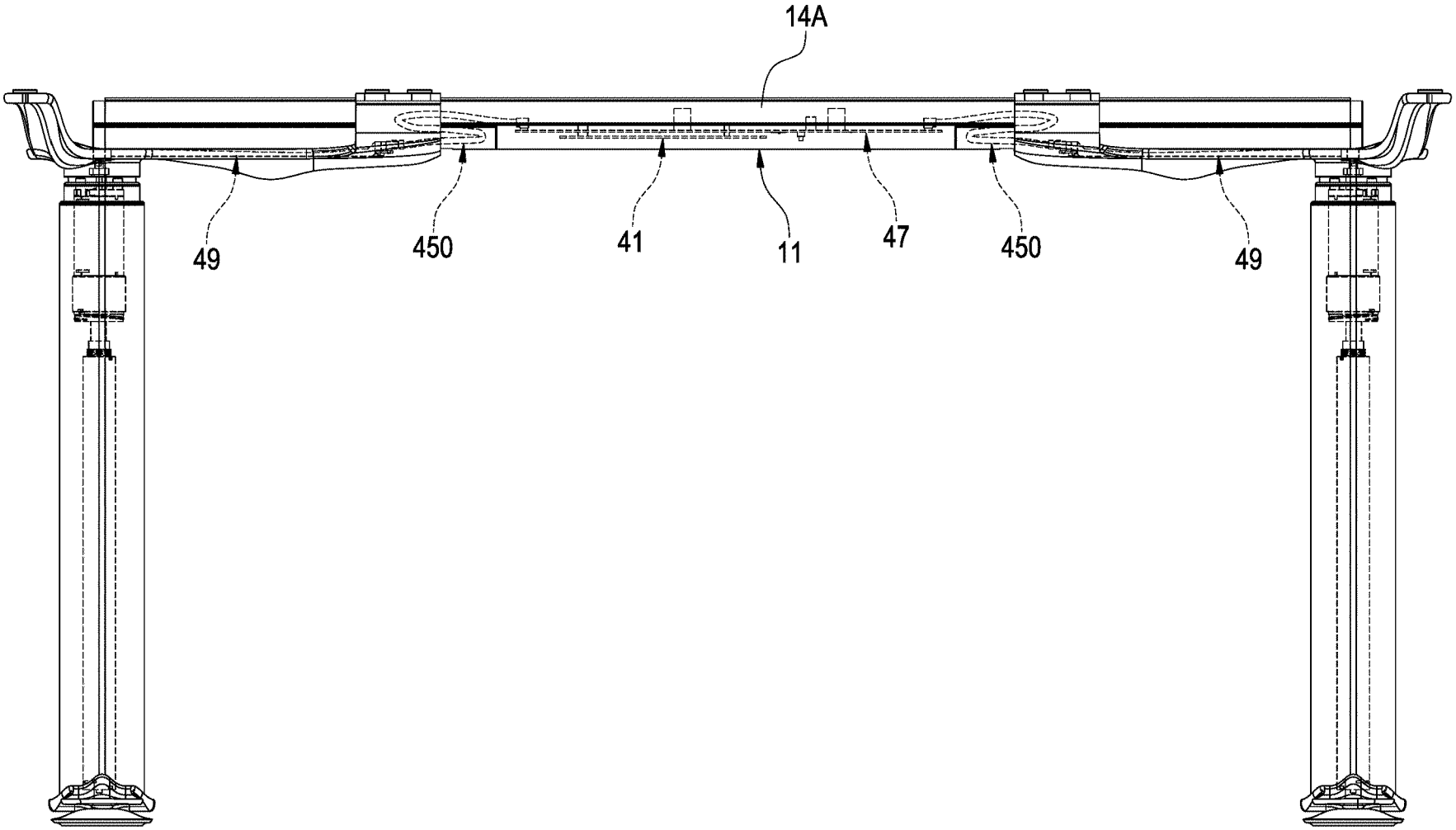
FIG. 12 is a front assembled view illustrating another embodiment of the present invention.

Referring to FIG. 12, in the present embodiment, the first guide module 46 and the third guide module 48 are replaced with a guide wire 450, and two ends of the guide wire 450 are electrically connected to one end of the guide module 47 and one end of the fourth guide module 49, thereby greatly saving costs of materials.

In summary, the electric table stand for simple assembly and adjustment according to the present invention can indeed achieve the anticipated effects and purposes, and solve the problems of conventional techniques. The present invention has novelty and inventiveness, and completely meets the requirements for patentability. Therefore, a request to patent the present invention is filed according to patent laws. Examination is kindly requested, and allowance of the present invention is solicited to protect the rights of the inventor.

What is claimed is:

1. An electric table stand for simple assembly and adjustment, comprising:

a beam structure (10);

a pair of support bars (20), each of the support bars (20) including a base plate (21) and a plurality of arms (211, 212, 213) extended from the base plate (21), wherein the arms (211, 212, 213) include a first arm (211) which is extended from one side of the base plate (21), a second arm (212) which is extended in an opposite direction to the first arm (211), and a third arm (213) which is extended away from a connection direction of the first arm (211) and the second arm (212); an accommodating space (A) is formed among the base plate (21), the first arm (211), the second arm (212), and the third arm (213), one end of the beam structure (10) is disposed on and supported by the third arm (213) of one support bar (20), and the beam structure (10) is operatively moved in or out of the accommodating space (A);

a pair of upright structures (30), wherein the upright structures (30) are connected to the support bars (20) respectively;

wherein end portions of the first arm (211), the second arm (212) and the third arm (213) have a height difference with the base plate (21), which are on a same plane different from the base plate (21); and wherein the first arm (211), the second arm (212), the third arm (213) and the base plate (21) are unitarily formed in one piece.

2. The electric table stand for simple assembly and adjustment according to claim 1, wherein the third arm (213) includes a supporting element (2131) and a fixed plate (2132) extended horizontally from an end of the supporting element (2131), and the third arm (213) supports the beam structure (10).

3. The electric table stand for simple assembly and adjustment according to claim 2, wherein the beam structure (10) includes a middle section beam (11) and two side section beams (12) respectively connected to ends of the middle section beam (11), a pair of guide grooves (13) are defined in side edges of the middle section beam (11) and each side section beam (12), and a pair of protruding strips (2133) protrude from an inner surface of the supporting element (2131), and the protruding strips (2133) are engaged with the guide grooves (13) respectively.

4. The electric table stand for simple assembly and adjustment according to claim 3, wherein the middle section beam (11) includes an upper cover (111) and a lower cover (112) assembled with the upper cover (111), and the middle section beam (11) is provided with two joining portions (113) at two ends of the middle section beam (11), each of the side section beam (12) includes an upper cover (121) and a lower cover (122) assembled with the upper cover (121), one end of the side section beam (12) is provided with a linking portion (123), and each of the side section beams (12) is coupled to each of the joining portion (113) of the middle section beam (11) through the linking portion (123).

5. The electric table stand for simple assembly and adjustment according to claim 3, wherein the beam structure (10) further includes a casing pipe (14), the casing pipe (14) encloses the middle section beam (11) and each of the side section beams (12).

6. The electric table stand for simple assembly and adjustment according to claim 5, wherein the beam structure (10) further includes a pair of end covers (15), and each of the end covers (15) covers one end of each side section beams (12) away from the middle section beam (11) and is connected to the casing pipe (14).

7. The electric table stand for simple assembly and adjustment according to claim 1, wherein each of the upright structures (30) includes an electric motor (31), a plurality of extendable tubes (32), and an electrical contact (33), the electric motor (31) is installed inside each of the extendable tubes (32), and the electrical contact (33) is fixed to an upper end surface of each extendable tube (32) and electrically connected to the electric motor (31).

8. The electric table stand for simple assembly and adjustment according to claim 7, further comprising an electrical device (40), wherein the electrical device (40) includes a controller (41) and a conductive circuit (45) electrically connected to the controller (41), the beam structure (10) includes a middle section beam (11) and two side section beams (12) respectively connected to ends of the middle section beam (11), the controller (41) is installed inside the middle section beam (11), and the conductive circuit (45) is installed inside the middle section beam (11) and each side section beam (12).

9. The electric table stand for simple assembly and adjustment according to claim 8, wherein the conductive circuit (45) includes a first guide module (46), a second guide module (47), and a third guide module (48), the first guide module (46) is installed in one of the side section beams (12), the second guide module (47) is installed in the middle section beam (11), and the third guide module (48) is installed in the other side section beam (12).

10. The electric table stand for simple assembly and adjustment according to claim 9, wherein the conductive circuit (45) further includes a fourth guide module (49), and the fourth guide module (49) is installed in the base plate (21).

11. The electric table stand for simple assembly and adjustment according to claim 10, wherein the base plate (21) is provided with a wire-receiving groove (214), and the fourth guide module (49) is embedded in the wire-receiving groove (214) and fixed by a press plate (22).

12. The electric table stand for simple assembly and adjustment according to claim 1, further comprising an electrical device (40), wherein the electrical device (40) includes a controller (41) and a conductive circuit (45) electrically connected to the controller (41), the conductive circuit (45) includes a second guide module (47), and the beam structure (10) includes a middle section beam (11) and a casing pipe (14A), an opening (141A) is defined inside the casing pipe (14A), the controller (41) and the second guide module (47) are installed inside the middle section beam (11), and the middle section beam (11) is coupled to the casing pipe (14A) corresponding to the opening (141A).

13. The electric table stand for simple assembly and adjustment according to claim 12, wherein the conductive circuit (45) further includes a lead line (450) and a fourth guide module (49), the fourth guide module (49) is installed in the base plate (21), and two ends of the lead wires (450) are electrically connected to the second guide module (47) and the fourth guide module (49), respectively.

14. The electric table stand for simple assembly and adjustment according to claim 1, further comprising an electrical device (40), wherein the electrical device (40) includes a controller (41) and a conductive circuit (45) electrically connected to the controller (41), the conductive circuit (45) includes a first guide module (46), a second guide module (47), and a third guide module (48), the beam structure (10) includes a middle section beam (11) and a casing pipe (14A), an opening (141A) is defined inside the casing pipe (14A), the controller (41) and the second guide module (47) are installed inside the middle section beam (11), the middle section beam (11) is coupled to the casing pipe (14A) corresponding to the opening (141A), and the first guide module (46) and the third guide module (48) are respectively installed inside the casing pipe (14A) on two sides thereof.

* * * * *